United States Patent [19]

Staub et al.

[11] 4,183,776

[45] * Jan. 15, 1980

[54] TENNIS RACKET MANUFACTURE

[75] Inventors: Anthony F. Staub; Norman T. Staub, both of Dayton, Ohio; John R. Erwin, Paradise Valley, Ariz.

[73] Assignee: Starwin Industries, Inc., Dayton, Ohio

[ * ] Notice: The portion of the term of this patent subsequent to Aug. 28, 1990, has been disclaimed.

[21] Appl. No.: 827,670

[22] Filed: Aug. 25, 1977

Related U.S. Application Data

[60] Division of Ser. No. 480,462, Jun. 18, 1974, Pat. No. 4,045,025, which is a continuation-in-part of Ser. No. 332,130, Feb. 13, 1973, abandoned, which is a division of Ser. No. 107,304, Jan. 18, 1971, Pat. No. 3,755,037.

[51] Int. Cl.[2] ..... B65H 81/00; A63B 49/10

[52] U.S. Cl. ..... 156/156; 156/171; 156/172; 156/188; 156/191; 156/245; 264/137; 264/258; 264/313; 264/314

[58] Field of Search ..... 273/73 F, DIG. 71; 156/173, 171, 175, 172, 184, 171, 185, 188, 245, 156; 264/314, 313, 258, 137

[56] References Cited

U.S. PATENT DOCUMENTS

| | | | |
|---|---|---|---|
| 2,573,361 | 10/1951 | Rodgers, Jr. et al. | 156/171 |
| 3,483,055 | 12/1969 | Eshbaugh | 156/190 |
| 3,755,037 | 8/1973 | Erwin et al. | 273/73 F |
| 3,810,803 | 5/1974 | Karp et al. | 273/73 F |
| 3,993,308 | 11/1976 | Jenks | 273/73 F |

FOREIGN PATENT DOCUMENTS

| | | | |
|---|---|---|---|
| 1122895 | 8/1968 | United Kingdom | 273/73 F |

*Primary Examiner*—Michael W. Ball
*Attorney, Agent, or Firm*—Biebel, French & Nauman

[57] ABSTRACT

A tennis racket frame is constructed primarily of an elongated hollow tube member having a wall thereof consisting essentially of a plurality of concentric layers of high tensile strength fibers impregnated and bonded together by binder resin, at least two of the layers being helical windings of opposite unidirectional hands, and the head portion of a racket frame having a groove molded therein to receive the loop portions of the strings in recessed relation to the surrounding surface areas of the frame. The frames are made by a method including the use of a special mandrel on which the layers of fiber are wound under controlled conditions providing extra material in the head portion which is formed into the wall of the grooved portion of the head without affecting the overall sectional dimensions of the frame.

4 Claims, 21 Drawing Figures

TENNIS RACKET MANUFACTURE

CROSS-REFERENCE TO CORRESPONDING APPLICATIONS

This application is a division of application Ser. No. 480,462, filed June 18, 1974 now U.S. Pat. No. 4,045,025 as a continuation-in-part of application Ser. No. 332,130 now abandoned filed Feb. 13, 1973 as a division of application Ser. No. 107,304, filed Jan. 18, 1971 and now U.S. Pat. No. 3,755,037.

BACKGROUND OF THE INVENTION

This invention relates to the manufacture of rackets, and particularly to tennis rackets although the principles thereof are applicable to any type of strong racket, e.g. squash rackets.

Throughout most of the history of racket sports, all good rackets were made primarily of wood, generally in the form of a plurality of curved pieces laminated together by glue or the like. These rackets possessed many desirable qualities from the standpoint of strength, but also were subject to certain disadvantages. For example, wood is of variable quality at best, and wood of the best quality is increasingly scarce. In any event, wood is subject to warping and to fatigue, particularly under the stress of tightly stretched strings, and accurate control of weight, and especially of balance, was difficult.

Comparatively recently, the art has produced rackets wherein the frame is constructed of steel or aluminum. Obviously, a racket frame of such a material does not warp and possesses a very high degree of strength, but the initial cost of materials, as well as the cost of the equipment for forming the metal racket frames, is high, thereby making the consumer cost of such a racket high. Further, metal frames have problems of cracking of welds, and with physical properties of density, strength and stiffness tending to result in rackets which are too flexible.

The use of glass reinforced plastic materials has become widespread during this same period of time. It is well known that the glass reinforced plastics have a very high strength, they have a good modulus of elasticity, the raw materials are inexpensive, and they can be readily formed and otherwise handled. The use of glass reinforced plastic in a tennis racket frame was proposed as long ago as 1949, in Robinson U.S. Pat. No. 2,878,020. Yet in spite of this knowledge and early suggestion, the art has been unable to develop a satisfactory racket frame formed of fiber reinforced plastic material.

SUMMARY OF THE INVENION

The racket frame provided by the invention has as its primary structural member an elongated hollow tube, the wall of which consists essentially of a plurality of concentric layers of glass fiber impregnated and bonded together by binder resin. The majority of these fiber layers are helical windings of predetermined unidirectional hand with respect to the longitudinal axis of the tubular member, alternate windings being of opposite hand, but there should also be one or more layers wherein the fibers run lengthwise of the tube to provide adequate bending strength in the finished frame. This tubular member is formed in a loop so that its central portion defines the head of the racket frame, and the two end portions converge at the base of the head portion to define an open throat from which they extend in parallel relation to form the frame handle, to which a suitable grip is applied.

Special features of the frame of the invention include a groove molded in the outer end part of the head portion for receiving loop portions of the racket strings in recessed relation with the surrounding peripheral area of the frame. Special provision is also made for reinforcing the throat portion of the frame, preferably by means of a filler member positioned between the converging parts of the tube and secured in bridging relation therewith, in one form by layers of fiber and binder, and in another form by means of the racket strings.

The method of the invention by which the racket frames are produced, namely by applying successive layers of binder-impregnated fiber to a removable matrix, lends itself particularly well to the establishment of the proper strength characteristics at stress points in the frame, as well as proper characteristics of weight, balance and flexibility or stiffness which are important for the best playing qualities. For example, the windings of which the tubular member is composed can be varied in number and length to provide extra wall thickness in the head portion of the racket as compared with the handle portion. Similarly, after the tubular member has been formed to the basic racket shape, reinforcement can be provided where it may be needed, in the throat and/or handle portion, by cover layers of binder-impregnated fiber which are bonded into the integral frame during the subsequent curing of the binder.

The method by which the racket frames of the invention are produced is generally as described in our above noted U.S. Pat. No. 3,755,037, but since the filing of that original application, improvements have been made in the method, particularly in connection with the formation of the groove in the racket head which receives loop portions of the strings. The matrix upon which the successive layers of fabric are wound includes an elastomeric tube, a removable core for this tube composed of multiple wires, and a filler member which is of approximately the same length and cross section as the groove and extends along a central portion of the matrix.

When the successive fiber layers are applied to this matrix, the filler member causes the wall of the resulting tubular member to be of correspondingly greater peripheral dimensions along its central portion as compared with the portions beyond each end of the filler member. Then when the uncured tubular member is subsequently placed in a mold and expanded by the internal pressure, the greater periphery provided by the extra material in its central portion makes it possible for the tubular member to be fully molded around a rib in the mold cavity and thereby forms the groove in that portion of the tubular member which becomes the outer end portion of the head of the racket frame but without affecting the overall cross-sectional outline of the head portion of the frame.

DESCRIPTION OF THE PREFERRED EMBODIMENTS

Figure 1:
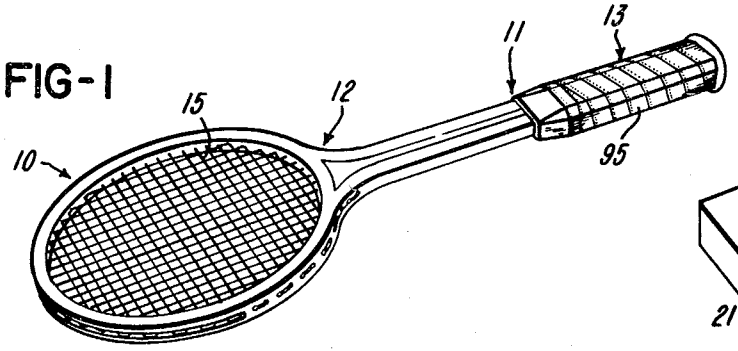
FIG. 1 is a perspective view showing a complete racket in accordance with the invention.
Figure 7:
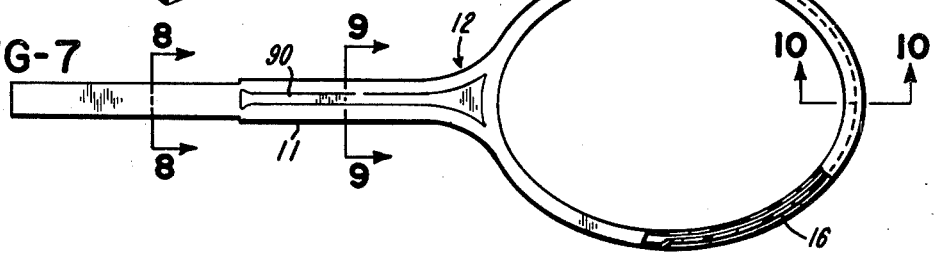
FIG. 7 is an elevational view, partially broken away, of the racket frame following the stage of FIG. 6.
Figure 8:
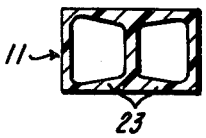
FIGS. 8, 9 and 10 are enlarged sections on the lines 8—8, 9—9 and 10—10 respectively of FIG. 7.
Figure 9:
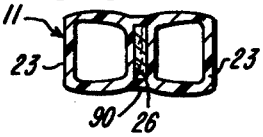
Figure 10:
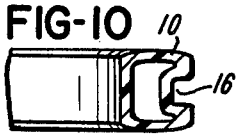
Figure 11:
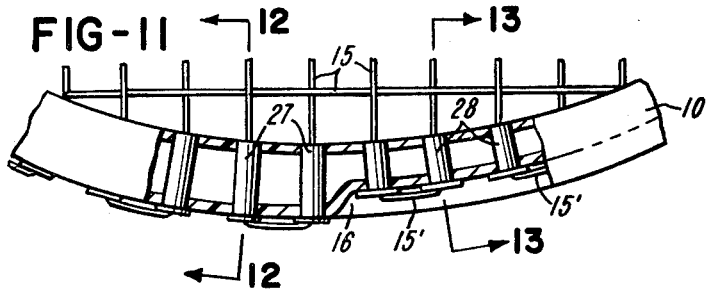
FIG. 11 is an enlarged fragment of the head of the complete racket of FIG. 1, partially broken away in section.

FIG. 1 shows a complete tennis racket in accordance with the invention in which the frame includes a generally oval shaped head portion 10, a handle portion 11, and a throat portion 12 interconnecting the head and handle portions. The handle 11 is provided with a grip 13, and the head 10 carries the strings 15. As shown in FIGS. 7 and 10, the head 10 is formed with a groove 16 extending around approximately the outer end half of its periphery, and the loop portions 15' of the strings are recessed in this groove below the adjacent peripheral portions of the frame for protection in use.

The basic structural part of this racket frame is the unitary tubular member 20, which includes the loop 21 defining the head 10, the converging sections 22 defining the throat 12, and the parallel end sections 23 defining the handle 11. The only other pieces of the frame, with the exception of the grip 13, are a filler piece 25 between the throat portions 22, and a fin-like spreader member 26 extending between the handle sections 23, both of which are optional and are made of light material such as balsa wood or plastic foam. Also, grommets 27 and 28 are provided as liners for the holes which receive the strings 15, the difference between the two sets of grommets being only that the grommets 28 have straight sided heads proportioned to seat within the groove 16.

FIGS. 2–10 illustrate successive stages in the manufacture of the racket frame of FIG. 1. The first stage is the formation of a mandrel comprising an elastomeric tube 30, core wires 31 and 32, and a filler member 33. The tube 30 is preferably of a rubber material which will not disintegrate in the curing cycle of a frame, and satisfactory results have been obtained with a rubber tube having an outer diameter of 7/16 inch and a wall thickness of 1/32 inch. The length of this tube should be somewhat in excess of the final length desired for the tubular member 20.

It is possible to use only a plurality of wires 32 of small diameter, e.g. 1/16 inch, but it is quicker and easier to use also at least one wire or rod 31 of substantially larger diameter, e.g. ¼ inch and the rod 31 is shown as provided at one end with a drive collar 36. A sufficient number of the wires 32 is used to fill the tube 30 completely, and preferably to expand it slightly, for example to an outer diameter of ⅝ inch.

The purpose of the filler member 33 is to increase the peripheral dimension of the mandrel along its portion corresponding to the part of the head in which the groove 16 is formed. The member 33 can be placed within the tube 30, but it is simpler to locate it on the outside, and this is easily done by welding a section of quarter-inch rod 33 to the middle of a carrier wire 35 of the same length as the other wires 31–32. For a full size frame, the filler member 33 may be 21 inches long. One end of the wire 35 fits in a groove in the collar 36 and is held in place by an O-ring 37. The other end is similarly held on tube 30 by a similar O-ring 37.

Figure 2:
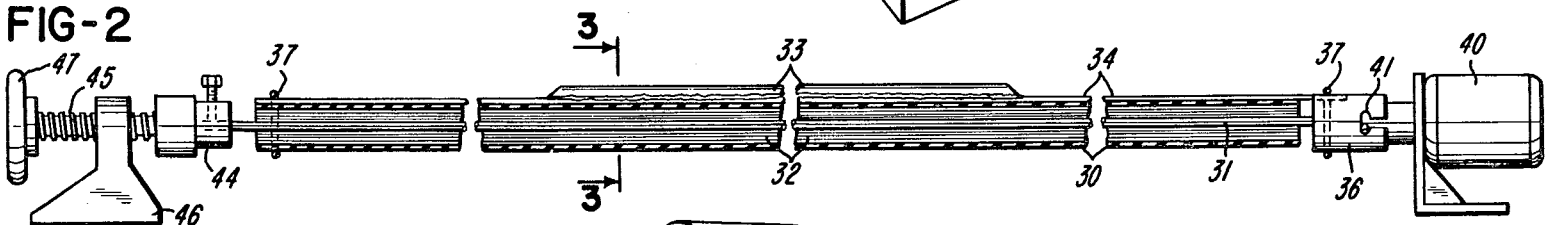
FIG. 2 is a fragmentary view, partially in side elevation and partially in vertical elevation, illustrating a preliminary stage in the fabrication of the racket of FIG. 1.
Figure 4:
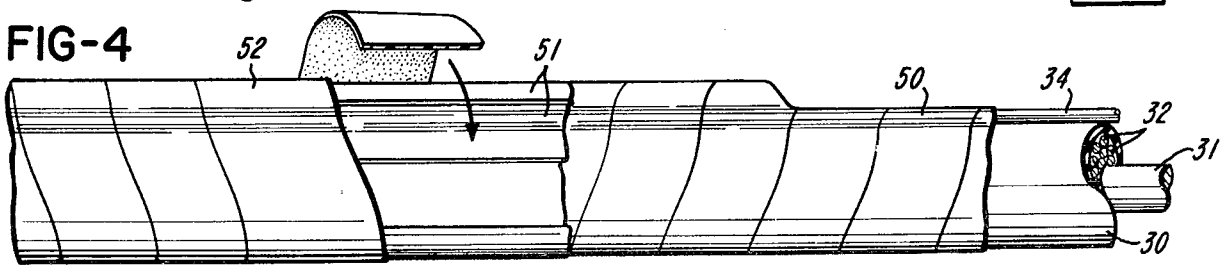
FIG. 4 is a further enlarged fragmentary view illustrating an intermediate stage in the fabrication of the tubular member which is the main structural part of the racket of FIG. 1.
Figure 3:
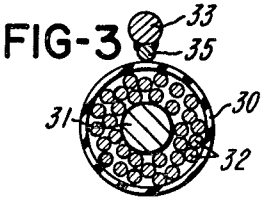
FIG. 3 is an enlarged section on the line 3—3 of FIG. 2.

The completed mandrel is then mounted in a tensioning and winding apparatus as shown in FIG. 2. The shaft of a low speed drive motor 40 holds and drives the collar 36 through a pin and bayonet slot connection 41. The other end of the rod 31 is secured in a chuck 42 mounted for free rotation on an adjustable tail stock comprising a screw 44 threaded in a stand 45 and having a handle 46. Backing off of the screw 44 will provide the necessary tensioning of rod 31 to support the entire mandrel in essentially straight position.

The multiple layers of binder-impregnated fiber are then successively applied to the mandrel, which is easily done while it is being rotated by the motor 40. To some extent, the number and sequence of application of these layers may be varied, but it is important that the majority of the layers be helically wound of unidirectional hand with successive such layers being of opposite hand, and also that there be at least one layer wherein the fibers run lengthwise of the mandrel and are not twisted. It is particularly important, for optimum results from the standpoint of both proper control of weight and the proper combination of strength and resiliency in the finished racket, to use tape composed of essentially continuous parallel filaments, as distinguished from woven or braided tape or tubing. One reason for this is that in a woven (mesh) tape, the cross fibers add thickness, since the thickness of the tape doubles at each crossover, and also weight without comparable contribution to strength for the purposes of the invention. In fact, the cross fibers would add no significant strength to applicant's frame as compared with continuous filament tape, but they would double the weight and effectively double the thickness of the wall of tubular member 20 for the same number of tape layers.

Another aspect of this matter is that in a fiber mat structure, wherein relatively short fibers are held together by resin binder, load transfers are required to take place through the resin securing adjacent fibers together, and this is an inefficient use of the tensile strength of the fibers. This same deficiency would be present in helically wound mesh tape, in that the cross fibers would be relatively short, and would have to depend on the resin to transfer loads therebetween. In contrast, with unidirectional continuous filament tape wound helically and with adjacent layers of opposite hand, the continuous filaments provide the most efficient transfer of loads throughout the frame, and their ability in this respect is increased when they are placed in tension in accordance with the practice of the invention as described hereinafter.

In a typical example of the practice of the invention, preferred results have been obtained by applying the following layers of binder-impregnated fiber tape one inch wide in the specified sequence:

A helical layer 50 extending slightly in excess of the full length desired for the tubular member 20, e.g. 63 inches.

A straight full length layer 51 composed of two lengths of the tape.

A second full length helical layer 52 of the opposite hand from layer 50.

Two helical layers of alternately opposite hand extending over only the central portion corresponding to the loop 21 and converging portions 22, e.g. 32 inches.

A full length helical layer 55 of the opposite hand from the adjacent under layer. Optionally, particularly for a heavier racket frame, two helical wraps of opposite hand may be applied before the layer 55 along only the central portion of the assembly overlying the filler member 33.

As soon as winding has been completed, the assembly is removed from the winding and tensioning apparatus, and the core wires 31 and 32 are removed from within the tube 30. The filler member 33 and its carrier wire 35 are then also easily removed, but it may be simpler to remove them and the tube 30, and then to replace the tube 30 in the uncured tubular shell.

It is quicker and simpler to utilize fiber tape already impregnated with binder than to add binder resin in the mold cavity during the final molding stage, and this is particularly true for continuous filament tape because the resin holds the non-woven filaments together. The pre-impregnated tape yields more uniform products, but it tends to be sticky at room temperature, and subsequent handling is facilitated if the tubular member is refrigerated after the core wires have been removed, preferably in a preform mold 60 having a cavity 61 closely corresponding to the mold cavity in which final curing of the frame is performed. It is also desirable at this stage and process to insert a generally triangular filler member 25 in the open throat area between the converging portions 22 of the tubular member, as well as the divider strip 26 between the handle portions 23.

Figure 6:
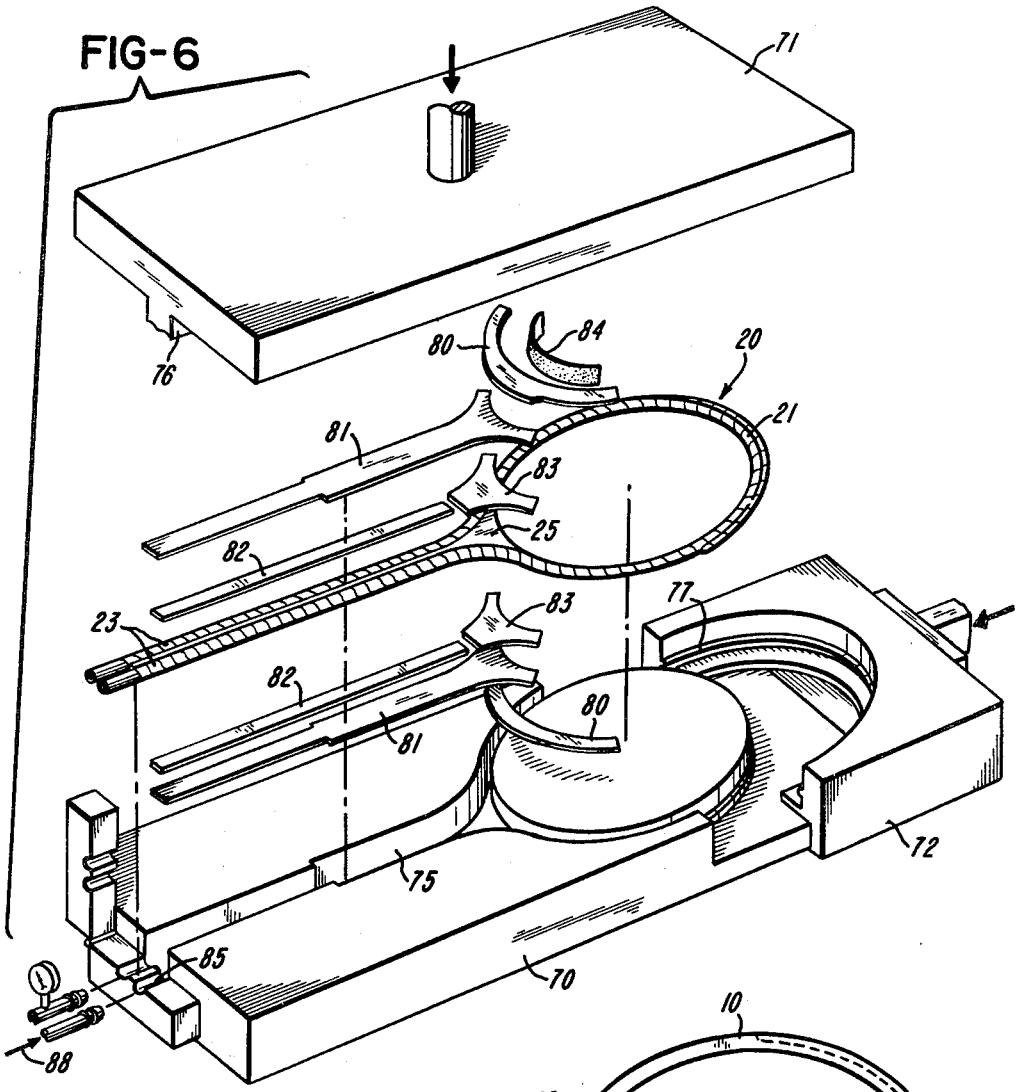
FIG. 6 is an exploded isometric view illustrating the operation of assembling the component parts for finally molding the racket frame.

The final assembly and molding operations are illustrated in FIG. 6 as carried out in a mold comprising three main parts 70, 71 and 72. The mold part 70 includes the bottom and sides of the cavity 75 corresponding to the handle portion of the racket frame, the throat portion, the inside of the head portion, and that part of the outside of the head portion which does not contain the groove 16. The upper mold part 71 includes a male section 76 defining the upper wall of the cavity 75 in the part 70. The part 72 is movable horizontally toward and away from the parts 70–71 and includes a cavity defining the outside of the head portion of the frame and incorporating an internal rib 77 located and proportioned to form the groove 16.

In the final assembling steps before closing the mold and curing the tubular member 20, a crescent-shaped strip 80 of binder-impregnated fiber is set in the bottom of that portion of the cavity in mold part 70 which underlies the filler piece 25 along the inner end of the head portion 10 and adjacent portions of the loop 21. A layer 81 of the fiber material of the same dimensions as width of the handle and throat portions is then set in the bottom of the cavity. Then a strip 82 of about half the width as the handle portion of the frame is set in the cavity, along with a piece 83 matching the outline of the throat portion of the frame. Also a strip 84 is set along the side of the cavity opposite the throat portion so that it will overlie the exposed edge of the filler piece 25 in the finished frame.

The refrigerated tubular member from the mold 60 is then set in the cavity 75, with the ends of the rubber tube 30 extending to the outside through appropriate grooves 85 in the mold. The divider strip 26 can be inserted at that time if it was not inserted when the tubular member was placed in the preform mold 60. A second series of strips 80–83 is then laid on top of the tubular member, after which the mold parts 71 and 72 are moved into position to close the mold.

For efficient production, the mold parts 70–72 are maintained at the desired curing temperature, so that as soon as the mold is closed, the refrigerated binder begins to soften. When it is thoroughly softened, for example after two to three minutes, air pressure is applied to the projecting ends of the tube 30 as indicated at 88, at a sufficient pressure to expand the tubular member 20 into firm engagement with all surfaces of the mold cavity and thereby to maintain all the fiber layers in tension while the binder is setting, and particularly to cause the slack fiber material opposite the rib 77 to engage this rib evenly in order to form the groove 16. This pressure is not critical, and satisfactory results have been obtained with air at a pressure of 40 p.s.i. The temperature of the mold and the time of curing are interdependent, in accordance with standard practice for the curing of fiber reinforced plastics. As previously noted, the temperature should not exceed the level at which the tube 30 would disintegrate before the end of the initial stage of the curing cycle.

Satisfactory results have been obtained if the initial stage of the curing cycle continues for a total of 15 minutes at 275° F., after which the pressure supply to the tube 30 is discontinued, the mold is opened, the tubular member is ejected, and the tube 30 is withdrawn from its interior. Any flash or other surplus material can then be removed, after which the cure should be completed, satisfactory results having been obtained in an oven at a temperature of 250° F. for a period of three hours.

Figure 12:
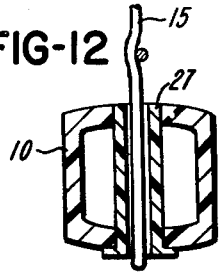
FIGS. 12 and 13 are further enlarged sections on the lines 12—12 and 13—13 of FIG. 11 respectively.
Figure 13:
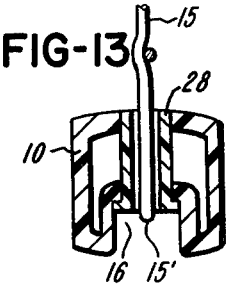
Figure 14:
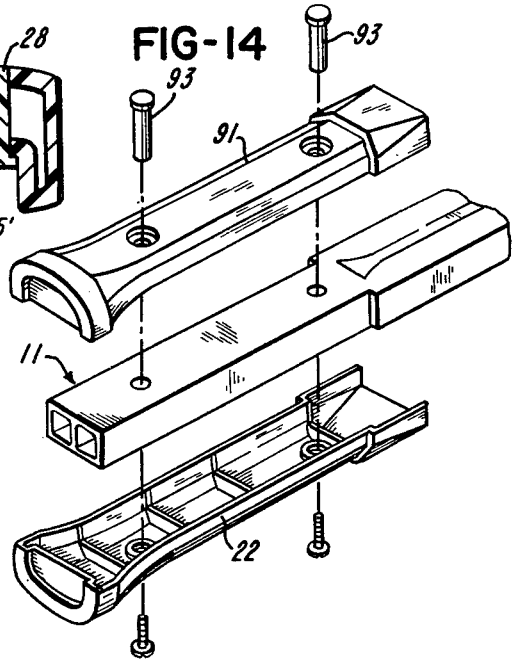
FIG. 14 is a fragmentary exploded view illustrating the assembly of the handle portion of the frame of FIG. 1.

The overall configuration of the frame after trimming and curing is shown in FIGS. 7–10 which illustrate that the fiber layers and binder effectively combine to form a solid wall in which all of the fibers are substantially uniformly tensioned for maximum strength. As best shown in FIGS. 12–13, the head portion 10 is symmetrical in sectional outline along both the grooved and non-grooved parts thereof, so that the grooved part would fit the peripheral outline of the ungrooved part, but the grooved part has a greater peripheral dimension, by reason of the extra fiber wall which defines the groove 16. Also, the thickness of the tubular member will vary in these parts of the head portion, depending upon how many layers of fabric were wound therein.

The handle portion 11 is illustrated as having a decorative groove 90 along the portion not covered by the grip 13 in the finished racket, such groove being imparted by appropriate complementary configuration of the mold parts 70–71 as desired. The outer end of the handle portion, however, is molded to a rectangular section for easy mounting of the grip 13, which is shown as formed in two complementary molded plastic parts 91–92 held in place by two bookbinder's screws 93 extending through holes drilled in the handle portion 11, and this mounting may be reinforced by adhesive. The grip is finished conventionally by a winding 95 of leather or plastic as shown in FIG. 1, and it is apparent that other grip means can also be used, such as grips formed by molding a suitable foam material around the end of handle part 11. Otherwise completion of the racket from the stage shown in FIG. 7 is conventional, involving drilling of the necessary holes for the strings 15, insertion of the grommets 27–28, and painting as desired.

Figure 15:
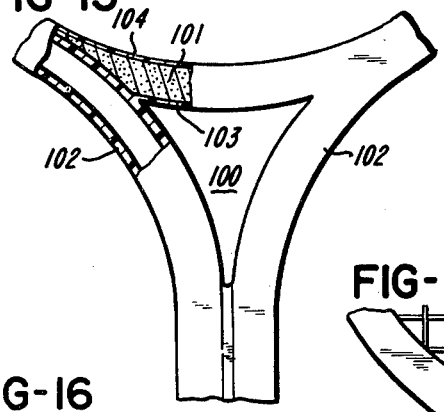
FIGS. 15 and 16 are fragmentary elevations, partially broken away, showing modifications of the racket frame of the invention having an opening in the throat portion thereof.
Figure 16:
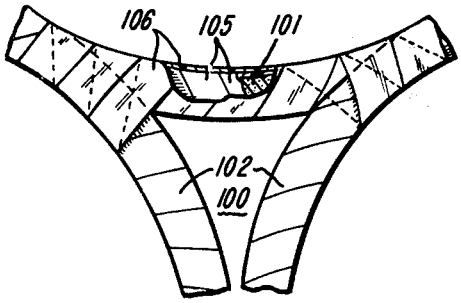
Figure 17:
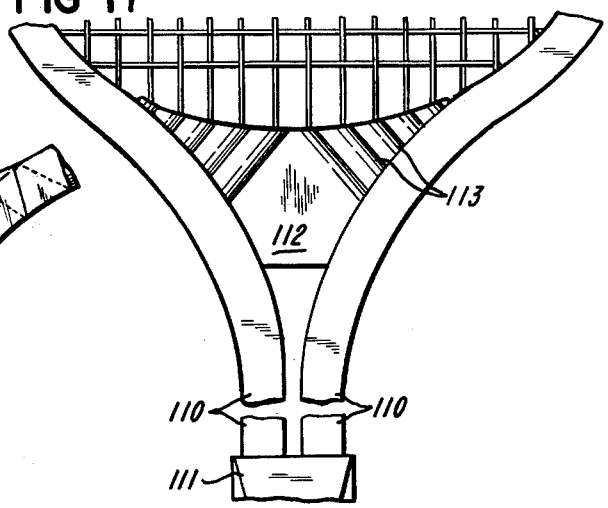
FIG. 17 is a fragmentary elevational view illustrating another modified frame construction in accordance with the invention.

Some modifications of the basic frame configuration shown in FIG. 1 are illustrated in FIGS. 15–17. Thus FIG. 15 shows a portion of a racket frame having an opening 100 through its throat portion, and in this case, a filler piece 101 of generally crescent shape is positioned between opposed locations on the converging sections 102 of the tubular member. The fabrication of this frame follows the same steps already described, but the strips of fiber which are applied in the mold are of appropriate configuration for the final design.

The filler piece 101 in FIG. 15 may be of balsa wood or plastic foam, since it serves merely as a support in the mold for the strips of resin-impregnated fiber which carry the load in the finished racket. A strip 103 of tape should be applied in the mold to cover the inner edge surface of filler piece 101 in the same manner as the strip 104, which corresponds to strip 84 in FIG. 6. An alternative construction is shown in FIG. 16, wherein the filler piece 101 is covered by a pair of windings 105 and 106 of tape of opposite hand, the ends of which also wrap around the joining portions of piece 101 and sections 102 to provide extra strength at those joints. One or more wraps of tape can similarly be provided around the joining portions of piece 101 and section 102 in the construction shown in FIG. 15.

FIG. 17 shows a racket frame in which the handle section 110 of the tubular member are exposed in spaced relation between the throat portion of the racket and the grip 111. This arrangement is readily established by appropriate complementary configuration of the preform mold and of the curing mold parts, and of course no divider 26 is used in this racket. The filler piece in the throat portion of this racket frame may be of essentially the same configuration as in FIG. 5, in which event it is bonded into position by overlying layers of fiber in the same manner already described, but it is shown as a separate molded plastic piece 112 held in place by the grommets which line the holes for the racket strings and by the strings themselves. As shown, this piece 112 has integral channels 113 molded therein for the racket strings. These channels could also be molded on radii of appropriate lengths such that the string in each channel 113 would leave the channel tangent thereto and thus minimize possible abrasion between the string and the end of the channel. Otherwise, this racket frame is of essentially the same construction already described in connection with FIGS. 1–14.

Figure 18:
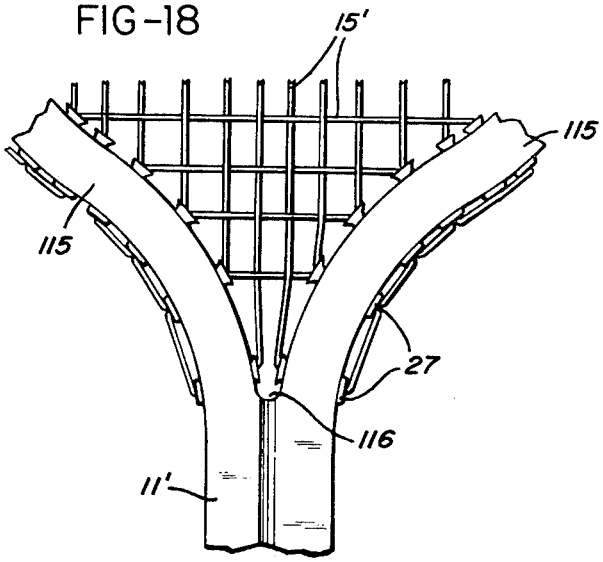
FIG. 18 is a fragmentary view similar to FIG. 17 illustrating still another frame construction in accordance with the invention.

FIG. 18 shows another modified construction wherein the converging portions 115 of the tubular member have no spacer or bridging means therebetween and thus define an open throat into which the strings 15′ extend, the converging portions 115 having enough holes for strings to extend across most of the open throat, and all of these holes being provided with grommets 27′. Thorough testing has established that this frame construction has all necessary strength, since overlying layers of resin-impregnated fiber corresponding to the layers 81 and 82 in FIG. 6 are also used in this construction to assure bonding of the handle portions of the tubular member together up to the point at which they begin to diverge at the apex 116 of the open throat.

It can be readily appreciated from the preceding description that the invention provides a high degree of versatility in the control of the strength, weight and balance of a racket frame. Thus for a heavyweight frame, the number of windings in its tubular member can be appropriately selected, and its balance can be established, by applying extra windings where needed, or by filler material at appropriate locations within the tubular member, for example within the outer end of its head loop. Similarly, the overall design is subject to wide modification exemplified by FIGS. 15–18.

Figure 19:
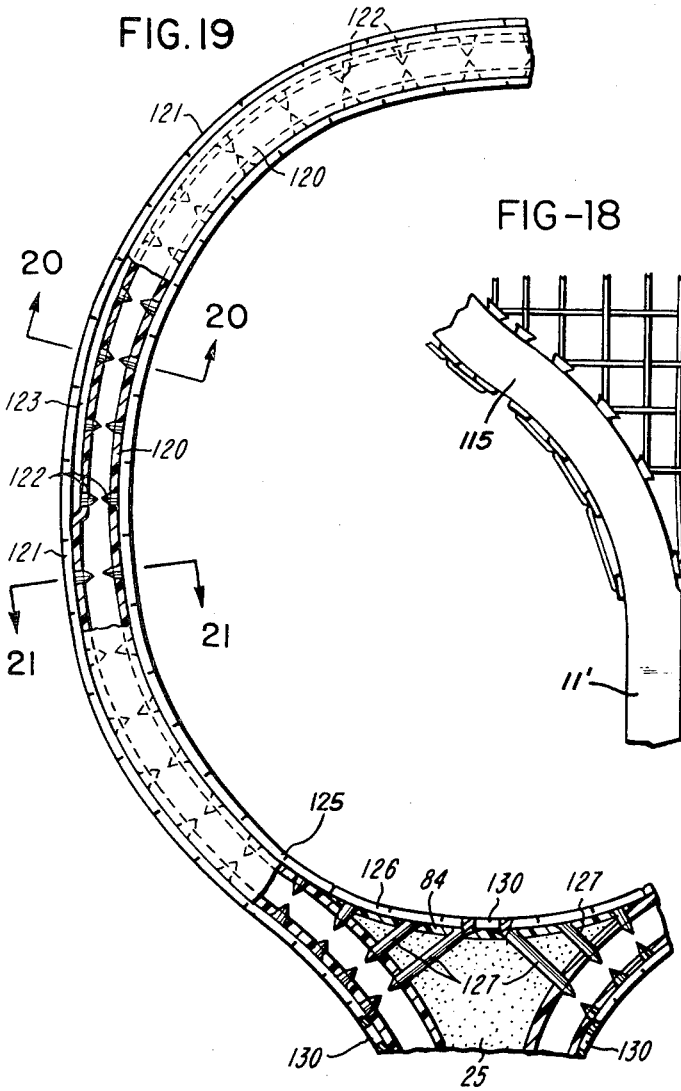
FIG. 19 is a fragmentary view illustrating a modification of the method of the invention wherein the holes for the racket strings are preformed.
Figure 20:
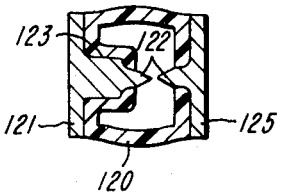
FIGS. 20 and 21 are enlarged sections on the lines 20—20 and 21—21 of FIG. 19.
Figure 21:
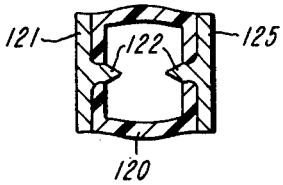

It is also possible to add to the method of invention the step of preforming the holes in the frame for the racket strings, instead of drilling them after molding is completed. This feature of the invention is illustrated in FIGS. 19–21 wherein the tubular shell 120 corresponds to the shell 20 in FIGS. 5 and 6 at the stage when it is ready for insertion in the preform mold 60 and is therefore relatively pliable and with the fibers in the successive layers relatively loosely held together.

A forming member 121 composed of a strip of flexible material includes multiple probe elements 122 arranged thereon in appropriately spaced relation corresponding to the spacing of the holes along the outer periphery of the head and throat section of the racket frame for receiving the racket strings. In addition, the forming member 121 includes a rib portion 123 corresponding in dimensions to the rib 77 in FIG. 6 which forms the groove 16 in the racket frame of FIGS 1–13. As shown, each of the probe elements 122 is provided with a relatively sharp point, and in section, its sides are curved to produce a rounded edge for the hole formed thereby in the wall of shell 120, but its length should be such that it will penetrate only the fiber layers and not tend to puncture the tube 30 while the latter is pressurized.

A similar flexible forming member 125 is proportioned to extend around the inner periphery of the head portion of the frame and incorporates probe elements 122 in appropriately spaced relation corresponding to the spacing of the string holes on the inner side of the racket head. An additional forming member 126 is configured to extend across the inside of the throat portion of the frame, and its proportions will vary in accordance with the design of the throat portion of the finished frame. The forming member 126 is shown as designed for use in producing a throat portion as illustrated in FIGS. 5–7, with probe elements 127 designed to penetrate through the foam filler piece 25 to the interior of the throat portions of the shell 120.

It will be apparent that with a racket frame of the open throat type, the member 126 could have probe elements 122 if an additional forming member is provided for insertion in the open throat portion opposite the member 126. Similarly, if the filler piece 25 is made of wood, it would be easier to utilize a forming member 126 having probe elements 122 only long enough to penetrate the fibers overlying such filler piece. In this case, the holes formed thereby would have to be connected with their mating holes in the shell 120 by drilling through the filler piece, and the holes in the inner wall portion of the shell could also be drilled or could be preformed by special probe elements like elements 127.

Figure 5:
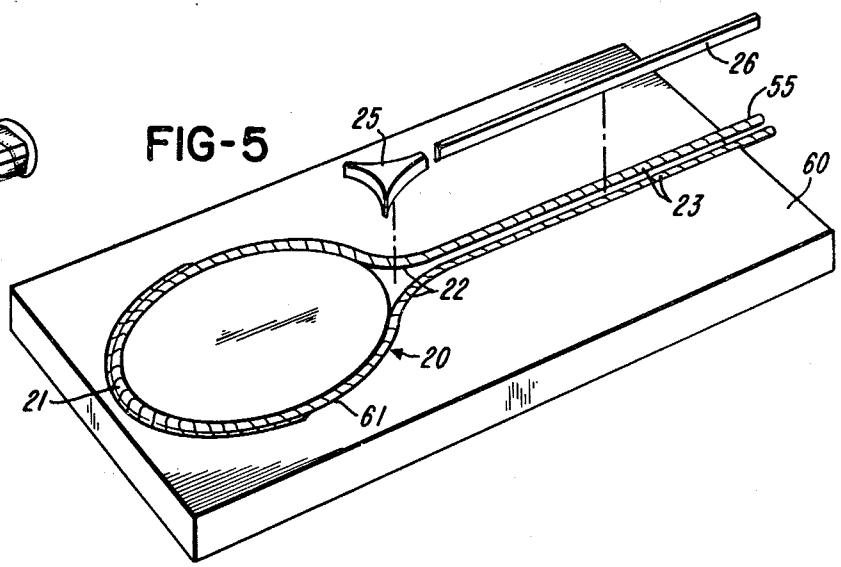
FIG. 5 is a partial exploded isometric view illustrating the preform mold and the corresponding stage in the fabrication of the racket frame.

In the practice of the invention as illustrated in FIGS. 19–21, the members 121, 125 and 126 are preferably applied to the shell 120 before or in connection with insertion in the preform mold as illustrated in FIG. 5. This can be done relatively easily, with the probe elements 122 being caused to pierce the shell wall by separating the fibers with minimum tendency to rupture any of the fibers. The forming members will then remain in place throughout the molding operation illustrated in FIG. 6, and they can be provided with appropriate locating means such as holes 130 positioned for engagement by locating pins in the mold or molds. During the application of heat and pressure to the shell as described, the pressure will cause the wall of the shell to conform smoothly to the forming members and their probe elements in the initial stage of the final molding operation when the binder softens preliminarily to hardening.

One advantage of this procedure is that the fibers are not cut or otherwise ruptured to form the holes for the racket strings, as they necessarily are when they are formed by drilling. This procedure also eliminates the separate drilling operation, since the only drilling necessary in the practice of the invention as illustrated in FIGS. 19–21 would be to connect opposed pairs of holes on opposite sides of a wood filler piece in the racket throat as noted above.

While the methods and articles herein described constitute preferred embodiments of the invention, it is to be understood that the invention is not limited to these precise methods and articles, and that changes may be made therein without departing from the scope of the invention.

What is claimed is:

1. The method of making a racket frame comprising the steps of:

(a) substantially filling an elastomeric tube at least as long as the peripheral outline of the frame with a removable core to form a mandrel, (b) supporting the resulting mandrel in straight position, (c) forming a tubular shell on said mandrel by successively applying thereto a plurality of individual layers of high tensile strength fiber impregnated with binder, (d) removing said core from within said tube, (e) placing said shell with said tube therein in a mold cavity defining a racket shape, (f) forming aligned pairs of holes for strings in opposite sides of said shell by separating the fibers in said fiber layers at predetermined opposed positions along the head defining portion of said shell without perforating said tube, (g) applying fluid pressure to said tube to press said shell into uniform contact with said mold cavity, and (h) hardening said binder while maintaining said pressure supplying step and said holes in said shell.

2. The method defined in claim 1 wherein said hole forming step is carried out by means of probe elements proportioned and positioned to pierce the wall of said shell substantially without rupturing the fibers therein or penetrating said tube.

3. The method defined in claim 1 wherein said forming operation includes the following steps:

(a) helically winding a first said fiber layer along substantially the full length of said assembly, (b) helically winding a second said fiber layer of opposite hand and substantially the same length around said first layer, (c) helically winding on said second layer a third said fiber layer of a shorter length equal only to the head portion of the racket frame, (d) helically winding a fourth said fiber layer of opposite hand and substantially the same length on said third layer, (e) applying a cover layer over said fourth layer of substantially the same length as said first and second layers.

4. The method as defined in claim 3 wherein said cover layer is helically wound.

* * * * *